US010337338B2

(12) United States Patent
Kampka et al.

(10) Patent No.: US 10,337,338 B2
(45) Date of Patent: Jul. 2, 2019

(54) WHEEL DISK ASSEMBLY HAVING SEALING PLATES

(71) Applicant: Siemens Aktiengesellschaft, Munich (DE)

(72) Inventors: Kevin Kampka, Mülheim a. d. Ruhr (DE); Christian Kowalzik, Berlin (DE); Peter Schröder, Essen (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 166 days.

(21) Appl. No.: 15/519,733

(22) PCT Filed: Oct. 12, 2015

(86) PCT No.: PCT/EP2015/073548
§ 371 (c)(1),
(2) Date: Apr. 17, 2017

(87) PCT Pub. No.: WO2016/066412
PCT Pub. Date: May 6, 2016

(65) Prior Publication Data

US 2017/0241276 A1 Aug. 24, 2017

(30) Foreign Application Priority Data

Oct. 30, 2014 (EP) ..... 14191066

(51) Int. Cl.
*F01D 5/30* (2006.01)
*F01D 5/32* (2006.01)
*F01D 11/00* (2006.01)

(52) U.S. Cl.
CPC ..... *F01D 5/3015* (2013.01); *F01D 5/323* (2013.01); *F01D 5/326* (2013.01); *F01D 11/006* (2013.01);
(Continued)

(58) Field of Classification Search
CPC ..... F01D 5/3015; F01D 5/323; F01D 5/326; F01D 11/006; F01D 11/005; F05D 2260/36; F05D 2260/37; F05D 2260/38
See application file for complete search history.

(56) References Cited

U.S. PATENT DOCUMENTS 3,070,351 A 12/1962 Hunt, Jr.
8,206,119 B2 * 6/2012 Liotta ..... F01D 5/3015 416/220 R

FOREIGN PATENT DOCUMENTS

WO WO202012149117 * 11/2012

OTHER PUBLICATIONS

EP Search Report dated Apr. 7, 2015, for EP patent application No. 14191066.1.

(Continued)

*Primary Examiner* — Bryan M Lettman
(74) *Attorney, Agent, or Firm* — Beusse Wolter Sanks & Maire

(57) ABSTRACT

A wheel disk assembly having a wheel disk, a plurality of blade devices fastened along an outer circumference of the wheel disk, a plurality of sealing plates accommodated between the wheel disk and the blade devices such that the sealing plates are moveable in the circumferential direction, and securing devices designed such that the securing devices secure the sealing plates against movement in the circumferential direction. Pins are provided as securing devices, which pins are detachably retained in bores arranged on the wheel disk and reach into recesses that are formed on (Continued)

surfaces of the sealing plates facing the wheel disk, wherein at least one of the pins, preferably all of the pins, are designed such that, in order to disengage a pin from the associated recess, the pin in question can be plunged further into the bore in a resilient manner.

10 Claims, 2 Drawing Sheets

(52) U.S. Cl.
CPC ..... *F05D 2230/64* (2013.01); *F05D 2260/37* (2013.01)

(56) References Cited

OTHER PUBLICATIONS

International Search Report dated Feb. 5, 2016, for PCT/EP2015/073548.

* cited by examiner

WHEEL DISK ASSEMBLY HAVING SEALING PLATES

CROSS REFERENCE TO RELATED APPLICATIONS

This application is the U.S. National Stage of International Application No. PCT/EP2015/073548 filed Oct. 12, 2015, and claims the benefit thereof. The International Application claims the benefit of European Application No. EP14191066 filed Oct. 30, 2014. All of the applications are incorporated by reference herein in their entirety.

FIELD OF INVENTION

The present invention relates to a wheel disk assembly, having a wheel disk, a plurality of blade devices, which are fastened along an outer circumference of the wheel disk, a plurality of sealing plates, which are received between the wheel disk and the blade devices such that they can be displaced in the circumferential direction, and securing devices designed so as to secure the sealing plates against displacement in the circumferential direction, wherein bolts are provided as securing devices, which bolts are releasably held in bores arranged in the wheel disk and engage in cutouts formed in the faces of the sealing plates oriented toward the wheel disk.

BACKGROUND OF INVENTION

Wheel disk assemblies of the type stated at the outset are known in the prior art. They form components of rotors such as gas turbines or the like. Normally, multiple sealing plates are received between the wheel disk and the blade devices, such that they can be displaced in the circumferential direction. Thus, the sealing plates can for example be inserted into annular grooves which are arranged radially spaced apart from one another, and which are formed on one hand in the wheel disk and on the other hand in the blade devices. In order to ensure proper functioning of the sealing plates, it is necessary to secure the individual sealing plates against displacement in the circumferential direction, to which end appropriate securing devices are used. A securing device of this kind can for example be formed by a screw extending through a through-hole provided in the sealing plate, and a tapped hole which is provided in the wheel disk and into which the screw is screwed in the properly assembled state. However, one problem of a securing device so formed is that the notch effect associated with the tapped hole provided in the wheel disk negatively affects the strength of the wheel disk, and can give rise to corresponding problems. Furthermore, it is often the case that screws cannot be removed during servicing, which implies laborious drilling-out of the screw connection, thereby damaging the costly wheel disk.

Thus, for example U.S. Pat. No. 3,070,351 discloses a securing ring for compressor rotor blades seated in axial slots. Clamping sleeves are provided in order to attach the securing ring to the blade wheel. The clamping sleeves are seated in aligned bores provided in the blade wheel on the one hand and in the securing ring on the other hand. However, the fit of the clamping sleeves is not additionally secured, and hence it is possible for the clamping sleeves to be lost.

SUMMARY OF INVENTION

Starting from this prior art, it is an object of the present invention to provide a wheel disk assembly of the type stated at the outset involving alternative construction.

In order to achieve this object, the present invention provides a wheel disk assembly of the type stated at the outset, which is characterized in that, in order to manually release the engagement of the respective bolt from the associated cutout, the respective bolts can be resiliently pressed further into the bore. The fact that the bolts of the securing devices according to the invention, in contrast to the prior art described in the introduction, are not screwed to the wheel disk but rather are merely inserted into bores of the wheel disk and, in order to release the engagement, can be resiliently pressed further into the bore, makes it possible to provide a self-locking bolt which does not require a further component to prevent loss. The sealing plate into which the bolt engages therefore simultaneously serves as the means for preventing loss of the bolt. Thus a simple and reliable wheel disk assembly is specified, which also permits particularly simple and rapid installation and removal of the sealing plates and bolts.

According to the invention, the at least one bolt has, at its end region oriented away from the wheel disk, at least one radially outwardly protruding projection as a bearing surface for an associated sealing plate. This ensures secure and proper positioning of the sealing plates while maintaining a defined separation between the wheel disk and the sealing plates.

According to a first embodiment, the bolts are configured such that, in their final installation position, braced against the base of the bore, they press resiliently against the faces of the sealing plates oriented toward the wheel disk. This ensures a play-free and thus low-wear fit of the bolt in the cutout of the sealing plate.

Advantageously, the bore can be untapped, such that the strength of the wheel disk is not reduced by the notch effect of threads.

According to one embodiment of the present invention, the bore has an essentially hemispherical bore base. Accordingly, a transition radius is provided between the bore and the bore base, which also prevents unnecessary weakening of the wheel disk.

Advantageously, the bolts have, at their end region oriented toward the wheel disk, at least one, and advantageously two spring legs engaging in the associated bore. This one-piece construction makes it possible for the bolts to be installed and removed simply and repeatedly. According to this embodiment, a separate spring is not necessary, which simplifies installation.

The spring legs are advantageously arranged opposite one another, thus achieving evenly acting clamping forces.

The at least one projection is advantageously annular, which is advantageous in particular with regard to production of the bolt.

According to one embodiment of the present invention, the cutouts formed in the sealing plates are formed as through-holes. This is advantageous from a production point of view. In addition, the bolts can be more easily inserted into the associated cutouts since they are visible from the outside through the through-holes.

Advantageously, the cutouts formed in the sealing plates are formed as radially extending elongate slots in order to be able to compensate for thermal expansion during proper use of the wheel disk assembly.

BRIEF DESCRIPTION OF THE DRAWINGS

Further features and advantages of the present invention will become clear from the following description of a wheel disk according to one embodiment of the present invention, with reference to the appended drawing, in which.

DETAILED DESCRIPTION OF INVENTION

FIGS. 1 to 5 show a wheel disk assembly 1 according to one embodiment of the present invention, or components thereof. The wheel disk assembly 1 comprises a wheel disk 2, multiple blade devices 3 which are attached along an outer circumference of the wheel disk 2, and multiple sealing plates 4 which extend between the wheel disk 2 and the blade devices 3, and are received such that they can be displaced in the circumferential direction U. More precisely, the sealing plates 4 are inserted into annular grooves which are arranged spaced apart from one another in the radial direction R, the annular grooves being formed on the one hand in the wheel disk 2 and on the other hand in the blade devices 3.

Figure 1:
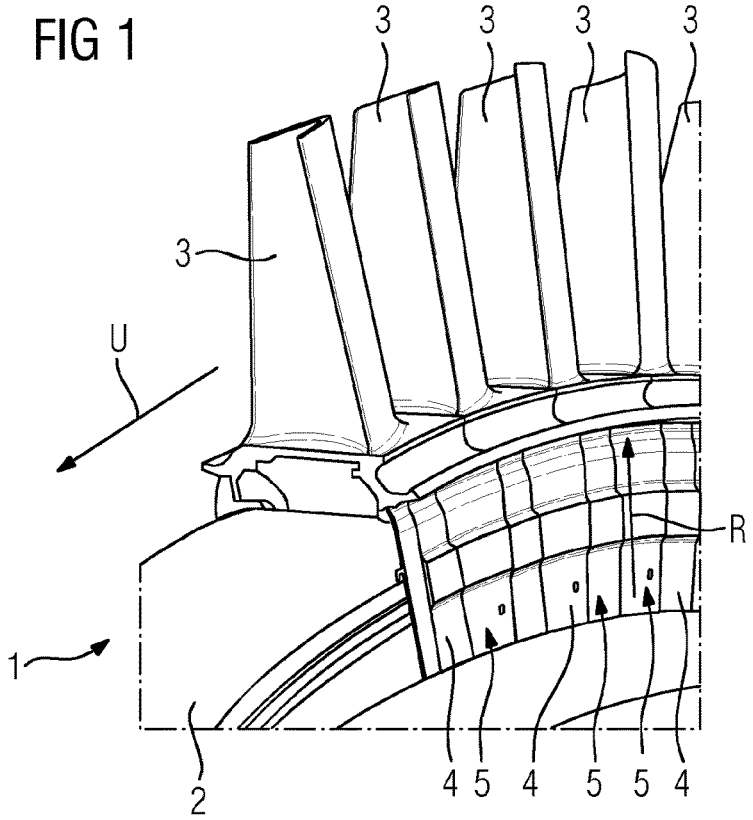
FIG. 1 is a schematic perspective view of a wheel disk assembly according to one embodiment of the present invention.
Figure 2:
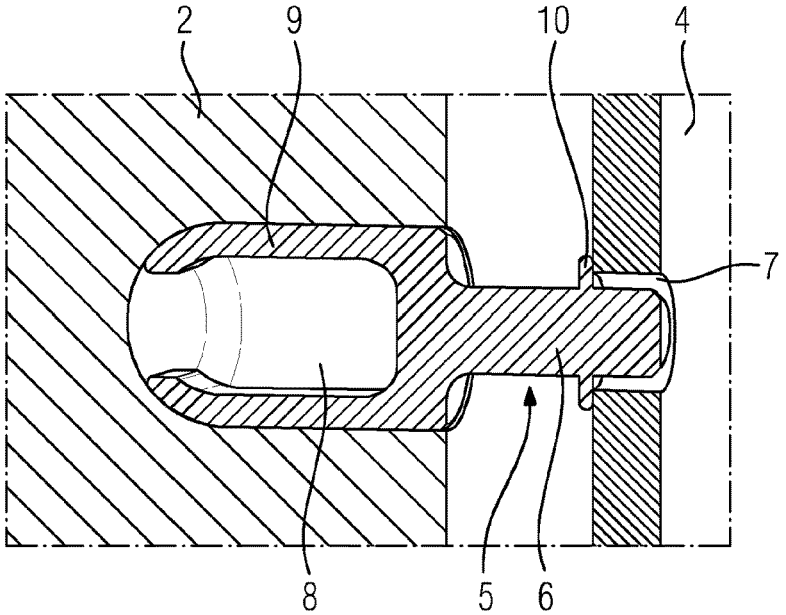
FIG. 2 is a schematic section view of a securing device of the wheel disk assembly shown in FIG. 1.
Figure 3:
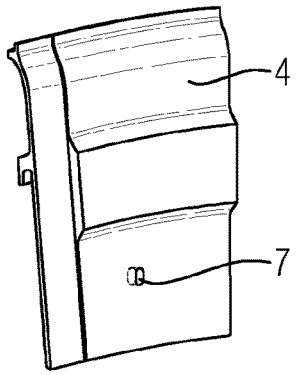
FIG. 3 is a schematic perspective view of a sealing plate of the wheel disk assembly shown in FIG. 1.
Figure 4:
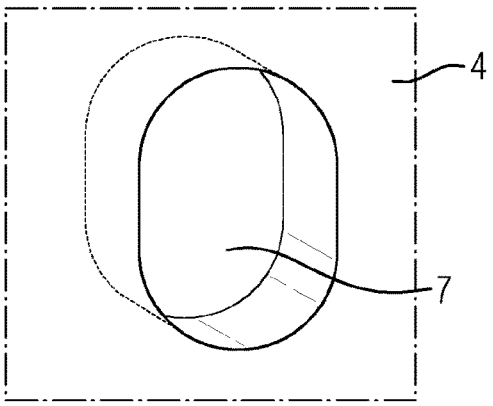
FIG. 4 is a detail view of a cutout formed in the sealing plate shown in FIG. 3.
Figure 5:
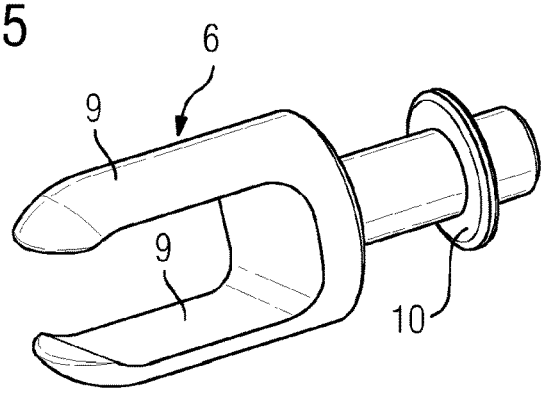
FIG. 5 is a schematic perspective view of a bolt of the securing device shown in FIG. 2.

In order to secure the sealing plates 4 against displacement in the circumferential direction U, the wheel disk assembly 1 comprises multiple securing devices 5, in the present case one securing device 5 for each sealing plate 4. Each securing device 5 has a bolt 6 which is attached to the wheel disk 2 and engages in a cutout 7 formed in the face of a respective sealing plate 4 oriented toward the wheel disk 2. The bolts 6 are held in a releasable, clamping manner in untapped bores 8 of the wheel disk 2, each bore 8 having an essentially hemispherical bore base. The bolts 6 have, at their end region oriented toward the wheel disk 2, two mutually opposite spring legs 9 which, in the properly installed state, bear against the wall of the bore 8 exerting a clamping force, as shown in FIG. 2. The bolts 6 have, at their end region oriented away from the wheel disk 2, a radially outwardly protruding projection 10 which in the present case is annular and serves as a bearing surface for an associated sealing plate 4. At the same time, the projection 10 serves as a spacer and defines a predetermined separation between the wheel disk 2 and the corresponding sealing plate 4. The cutouts 7 formed in the sealing plates 4 are provided as through-holes, more precisely as piercing, radially extending elongate slots, such that the bolts 6 have movement play in the radial direction R, in particular in the radial outward direction.

The wheel disk assembly 1 according to the invention is characterized in particular in that the spring legs 9 make it possible for the bolts 6 to be installed and removed simply and repeatedly. While, during installation, the bolt 6 is first pushed deep into the bore such that a sealing plate can then be moved past the end region of the bolt, for removal the bolt 6 must also be pushed into the bore 8 in order to release the engagement of the bolt 6 with the cutout 7, and thus allow the sealing plate to be displaced in the circumferential direction. In that context, the spring action of the bolt 6 is oriented such that the bolt moves at least partially out of its bore as soon as it is released.

Another advantage is that the bore 8 is untapped such that the strength of the wheel disk 2 is not unnecessarily affected by a notch effect. The essentially hemispherical bore base also contributes to strength. The projection 10 ensures a defined position of the sealing plates 4 in the properly mounted state. The design of the cutouts 7 as radially extending and piercing elongate slots, which allow the bolts 6 movement play in the radial direction, makes it possible to compensate for thermal expansion of the sealing plates 4 during design operation of the wheel disk assembly 1.

Although the invention has been described and illustrated in detail by way of the preferred exemplary embodiment, the invention is not restricted by the disclosed examples and other variations can be derived herefrom by a person skilled in the art without departing from the scope of protection of the invention.

The invention claimed is:

1. A wheel disk assembly, comprising:

a wheel disk, a plurality of blade devices which are fastened along an outer circumference of the wheel disk, a plurality of sealing plates which are received between the wheel disk and the plurality of blade devices such that they are displaceable in a circumferential direction, and securing devices which secure the plurality of sealing plates against displacement in the circumferential direction, wherein bolts are provided as securing devices, wherein in an installed state the bolts are releasably held in bores arranged on the wheel disk and engage in cutouts which are formed in faces of the plurality of sealing plates oriented toward the wheel disk, wherein in the installed state a resilience of at least one bolt of the bolts acts on a surface of an associated bore to create a push force that urges the at least one bolt out of the associated bore, and wherein in the installed state the at least one bolt transfers the push force to an associated sealing plate of the plurality of sealing plates, thereby urging the associated sealing plate away from the wheel disk, wherein in the installed state the resilience permits the at least one bolt to be pressed farther into the associated bore upon application of an external force in order to release an engagement between the at least one bolt and an associated cutout, and wherein the at least one bolt comprises, at an end region oriented away from the wheel disk, at least one radially outwardly protruding projection as a bearing surface that is effective to transfer the push force to the associated sealing plate.

2. The wheel disk assembly as claimed in claim 1, wherein all of the bolts, in order to release engagement from the associated cutout, are resiliently pressable further into associated bores, wherein all of the bolts comprise, at a respective end region oriented away from the wheel disk, at least one radially outwardly protruding projection as a respective bearing surface for an associated sealing plate.

3. The wheel disk assembly as claimed in claim 1, wherein the bolts, each braced against a base of an associated bore, presses against a surface of an associated sealing plate that faces the wheel disk.

4. The wheel disk assembly as claimed in claim 1, wherein the associated bore comprises a hemispherical bore base, and/or is untapped.

5. The wheel disk assembly as claimed in claim 1, wherein the at least one bolt comprises, at an end region oriented toward the wheel disk, at least one spring leg engaging in the associated bore.

6. The wheel disk assembly as claimed in claim 5, wherein the at least one spring leg comprises two spring legs arranged opposite one another.

7. The wheel disk assembly as claimed in claim 1, wherein the at least one radially outwardly protruding projection is annular.

8. The wheel disk assembly as claimed in claim 1, wherein the cutouts formed in the plurality of sealing plates are formed as through-holes.

9. The wheel disk assembly as claimed in claim 1, wherein the cutouts formed in the plurality of sealing plates are formed as radially extending elongate slots.

10. A wheel disk assembly, comprising:

a wheel disk comprising a plurality of bores;

a plurality of blade devices fastened to a circumference of the wheel disk;

a sealing plate received between the wheel disk and the plurality of blade devices such that the sealing plate is displaceable in a circumferential direction; and a bolt configured to interlock with the sealing plate to prevent displacement in the circumferential direction, wherein in an installed state: the bolt is releasably held in a bore of the plurality of bores and engages a cutout of the sealing plate; a resilience of the bolt creates a push force that urges the bolt out of the bore; the bolt transfers the push force to the sealing plate, thereby urging the sealing plate away from the wheel disk; and upon application of an external force the resilience of the bolt permits the bolt to be pressed farther into the bore in order to disengage the bolt from the cutout of the sealing plate, thereby freeing the sealing plate for the displacement in the circumferential direction.

* * * * *